United States Patent [19]

Corse

[11] 4,141,293

[45] Feb. 27, 1979

[54] ROTARY MULTI-COLOR PRINTING MACHINE

[75] Inventor: Louis G. Corse, l'Etang, France

[73] Assignee: Machines Chambon, Orleans, France

[21] Appl. No.: 793,309

[22] Filed: May 3, 1977

[30] Foreign Application Priority Data

May 7, 1976 [FR] France ..... 76 13688

[51] Int. Cl.[2] ..... B41F 5/06; B41F 13/40

[52] U.S. Cl. ..... 101/181; 101/247

[58] Field of Search ..... 101/181, 180, 183, 184, 101/174, 177, 216, 217, 218, 219, 221, 152, 136, 137, 139, 140, 142, 143, 144, 145, 247, 351, 352

[56] References Cited

U.S. PATENT DOCUMENTS

| | | | |
|---|---|---|---|
| 2,988,989 | 6/1961 | Crawford | 101/177 X |
| 3,625,145 | 12/1971 | Heatley, Jr. | 101/152 |
| 3,892,178 | 7/1975 | Staamann | 101/181 |
| 4,046,070 | 9/1977 | Halley | 101/216 |

*Primary Examiner*—J. Reed Fisher

*Attorney, Agent, or Firm*—J. Harold Nissen

[57] ABSTRACT

A rotary multi-color printing machine comprises a frame and a plurality of printing units each of which prints in a different color on sheet material passing through the machine. The printing units are mounted one above another in the frame so that the sheet material can pass successively through the printing units. Each printing unit comprises a counter-pressure roll, a blanket roll, a plate roll and an inking roll, the axes of the rolls being parallel. The plate roll and the blanket roll of each printing unit are rotatably mounted in a support. The counter pressure roll of each printing unit is rotatably mounted in the frame on one side of the support, and the inking roll of each printing unit is rotatably mounted in the frame on the other side of the support. The support is slidable relative to the frame in a direction which is horizontal and axial relative to the rolls. In this way, the sub-assembly of the support and all the blanket roll and all the plate rolls can be removed from the machine to change the plates.

13 Claims, 7 Drawing Figures

1
2
8
15
19
21
22
24
25
26
27
28
29
31
33
34
35
36
37
38
39
41
42
43
44
56
57
59
63
95

ROTARY MULTI-COLOR PRINTING MACHINE

BACKGROUND OF THE INVENTION

This invention relates to a rotary multi-colour printing machine particularly for use in offset printing.

Known rotary multi-colour printing machines generally comprise a number of printing units each associated with a different colour and arranged in spaced relationship, the sheet material to be printed passing through these units in turn. Because of this, these printing machines cover a considerable amount of floor-space. Also, the operation of changing plates before starting a new run is relatively lengthy and has to be carried out successively or in parallel in the various printing units. This represents a major drawback when the printing machine is intended to be used for printing short runs of a few thousand copies at the most.

The aim of the present invention is to eliminate these disadvantages by providing a printing machine of particularly simple and compact design which enables printing plates to be changed easily and rapidly.

SUMMARY OF THE INVENTION

The present invention provides a rotary multi-colour printing machine comprising a frame and a plurality of printing units each of which prints in a different colour on sheet material passing through the machine, the printing units being mounted in the frame one above the other so that sheet material can pass successively through the printing units, each printing unit comprising a counter-pressure roll, a blanket roll, a plate roll and an inking roll, the axes of these rolls being parallel, wherein the plate roll and the blanket roll of each printing unit are rotatably mounted in a support, the counter-pressure roll of each printing unit is rotatably mounted in the frame on one side of the support, and the inking roll of each printing unit being rotatably mounted in the frame on the other side of the support, and wherein the support is slidably mounted in the frame for movement in a direction which is horizontal and axial with respect to the rolls.

In order to effect a considerable reduction in both the vertical and horizontal dimensions of the machine the inking apparatus of each printing unit advantageously consists of an arrangement using a small-diateter rod applied under pressure against the inking roll and turning in the same direction as the latter, the film of ink that passes between the rod and the inking roll being spread by the rod.

Preferably, means are provided for automatically applying pressure to the rolls, separately or for all the printing units simultaneously, after the plate-changing operation.

Because of the close proximity of the printing units, this machine avoids the need for using an electronic system for registering the colours. The various colours are automatically brought precisely into the correct positions in relation to each other by a simple mechanical indexing of the various plate rolls, after the plates have been changed.

BRIEF DESCRIPTION OF THE DRAWINGS

A rotary multi-colour printing machine constructed in accordance with the invention will now be described, by way of example, with reference to the accompanying drawings, in which.

DESCRIPTION OF PREFERRED EMBODIMENTS

Figure 1:
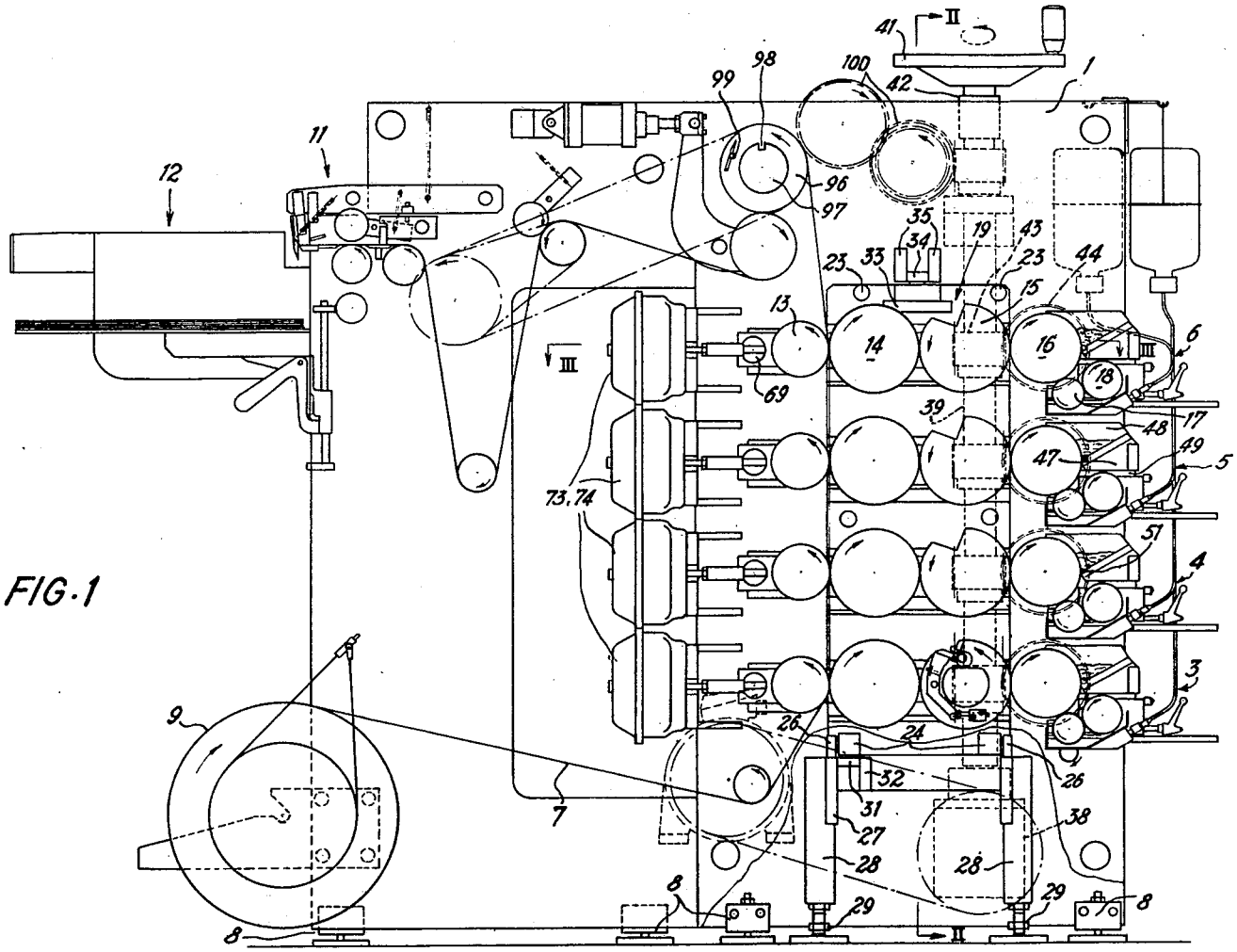
FIG. 1 is a diagrammatic elevational view of the printing machine, part thereof being shown as broken away.

Referring to the drawings, the rotary printing machine comprises a frame constituted by two parallel rear and front uprights 1 and 2 respectively, between which are arranged a plurality (four in the present example) of superposed printing units 3, 4, 5 and 6 for printing several colours on sheet material 7. The rear and front uprights 1 and 2 are suitably braced, and at the bottom of each of them there is fitted a screw-jack 8 for truing them in relation to the floor. The sheet material 7 is offwound from a roll 9 mounted to rotate at the bottom of the frame, and the sheet material passes in turn through the printing units 3, 4, 5 and 6, beginning at the bottom unit 3 and finishing at the top unit 6.

On leaving the printing machine, the sheet material 7 may be treated in any suitable manner, and in particular, cut into lengths by a rotary cutting machine 11 of conventional design, a collecting bin 12 for the cut sheets being provided at the delivery side of the cutting machine.

Since all the printing units 3, 4, 5 and 6 are constructed in the same manner, only one of them will be described in detail, that is the top printing unit 6. This printing unit 6 comprises a counter-pressure roll 13, a blanket roll 14, a plate roll 15, an inking roll 16, a wetting roll 17 and a wiping roll 18. The four counter-pressure rolls 13, blanket rolls 14, plate rolls 15 and inking rolls 16 are aligned horizontally and in contact with each other in the printing position as illustrated in FIG. 1. The counter-pressure rolls 13 and the inking rolls 16 are mounted to rotate on the frame 1, 2 whereas the two intermediate rolls of each unit, that is the blanket roll 14 and the plate roll 15 are mounted to rotate on the sub-frame 19 which can be moved horizontally and transversely in relation to the sheet material 7. In other words, the sub-frame 19 can be displaced horizontally in the direction at right-angles to the uprights 1 and 2 of the main frame. The sub-frame 19 comprises two parallel vertical cheek-plates, namely a rear cheek-plate 21 and a front cheek-plate 22 which are transversely interconnected by upper and lower stays 23 and 24 respectively.

Figure 2:
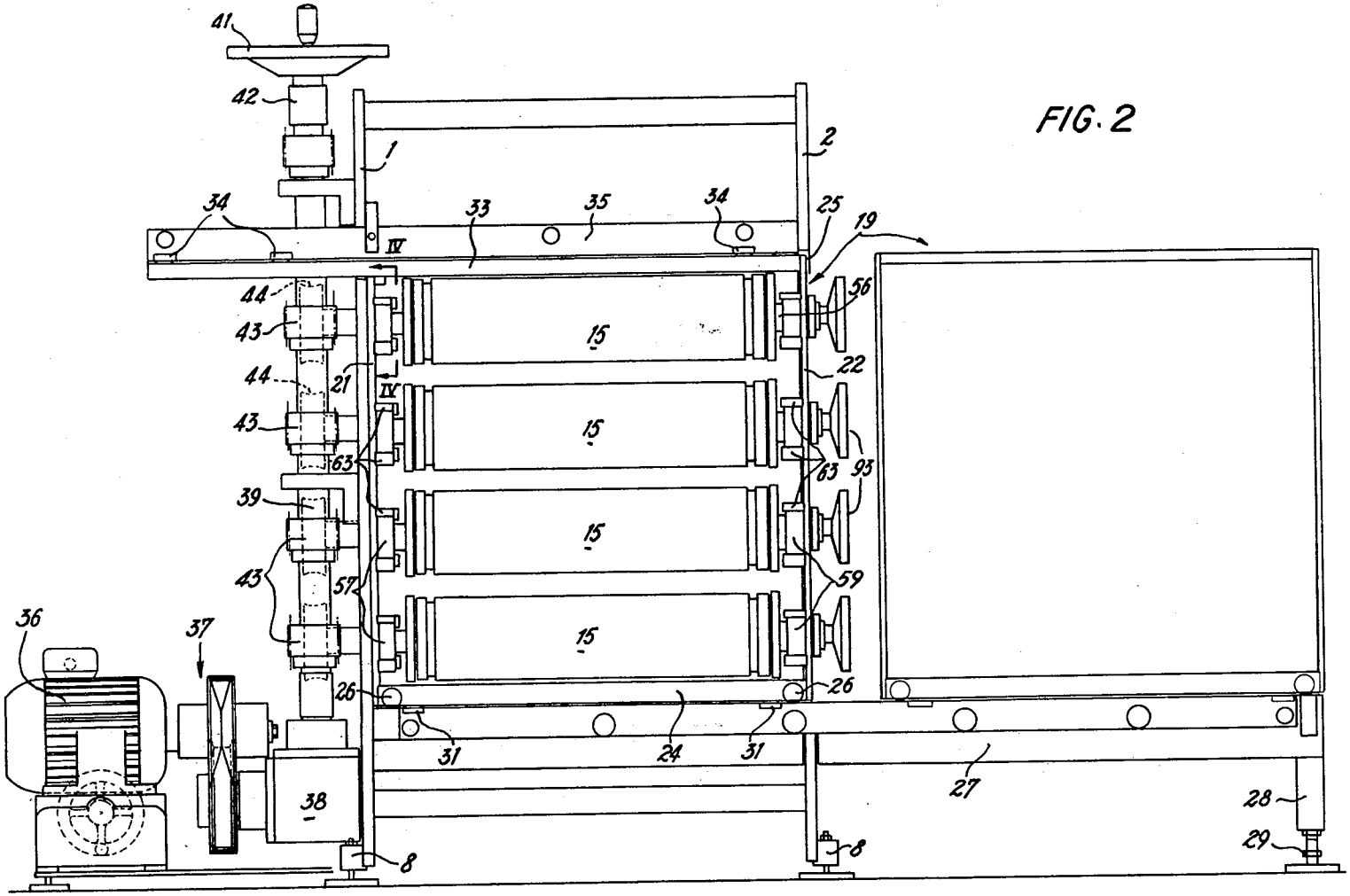
FIG. 2 is a vertical section on the line II—II of FIG. 1.

In the printing position, the sub-frame 19 is fully housed within the main frame of the machine, its rear cheek-plate 21 being disposed flat against the rear upright 1 of the main frame, whereas its front cheek-plate 22 is located in a vertical rectangular window 25 formed in the front upright 2 of the main frame to permit the sub-frame 19 to emerge. In FIG. 2 this sub-frame 19 is shown in relatively thick lines in the printing position, and in thinner lines in the position it occupies on emerging from the printing machine.

The lower stays 24 of the sub-frame 19 carry lateral rolls 26 having horizontal spindles, these rollers running on two horizontal transverse rails 27 which extend towards the front of the machine so as to receive the sub-frame 19 in its "out" position. These rails 27 are supported on the ground at their forward ends by way of two vertical columns 28 and two screw-jacks 29.

The sub-frame 19 is laterally guided at its lower part by rollers 31 which have vertical spindles and are mounted below the bottom stays 24 and move between each rail 27 and a horizontal transverse straight-edged element 32 (see FIG. 1). At its top the sub-frame 19 comprises a central cross-member 33 extending between the two cheek-plates 21 and 22 and carrying rollers 34 which have vertical spindles and are displaceable between two parallel horizontal transverse straight-edged elements 35 secured to the uprights 1 and 2 of the main frame. The cross-member 33 and the two straight-edged elements 35 extend towards the rear of the machine beyond the rear upright 1 as can be seen in FIG. 2, so that the sub-frame 19 cannot completely escape from the upper lateral guide means when it is in the front "out" position.

All of the printing units 3 to 6 are caused to rotate by an electric motor 36 arranged to the rear of the machine, and this motor is connected, by way of a variable speed transmission unit 37 and a bevel gear 38, to a vertical main operating shaft 39 extending over the entire height of the machine. At its upper end, the shaft 39 is connected to a hand-wheel 41 by way of a free wheel 42, so as to enable this shaft to be driven manually. The main control shaft 39 is connected to all the printing units and more particularly to the inking rolls 16 of these units. For this purpose it carries, in the zone of each of the various units, endless screws 43 which mesh with screw-threaded wheels 44 solidly connected to the shafts 45 (see FIG. 3) of the inking rolls 16. These rolls 16 are mounted to rotate in front and rear bearings 46 carried by the front and rear uprights 2 and 1 respectively of the main frame.

The inking apparatus of each of the printing units 3 to 6 comprises an ink container 47, the front and rear walls 48 of which bear on the lateral surface of the inking roll 16. The ink container rests on two horizontal strips 49 secured to the uprights 1 and 2 of the main frame and within these uprights. It also comprises a round metallic rod 50 which is caused to rotate by a continuous current electric motor, the speed of which can be varied. This rod 50 is applied under pressure to the inking roll 16 which is faced with rubber, the rod turning in the same direction as this roll and causing the ink to be spread over it. Screws fitted in the uprights 1 and 2 act on the ink container 47 and enable the penetration of the rod 50 into the inking roll 16 to be regulated, and these screws thus effect variation in the thickness of the film of ink.

The wetting rolls 17 and the wiping rolls 18 are the standard parts of wetting systems of conventional design and are mounted between the two uprights 1 and 2 of the main frame.

Figure 3:
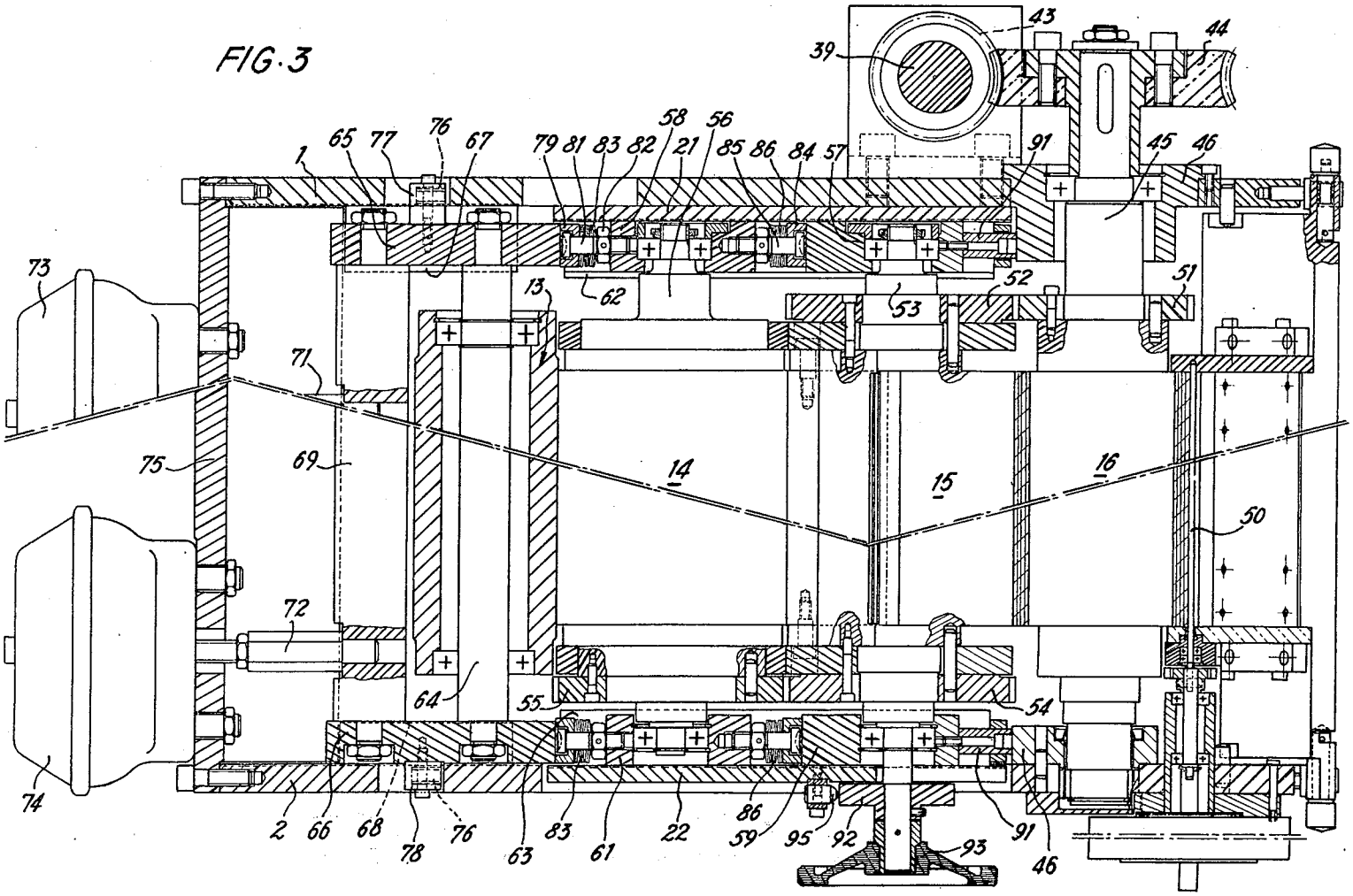
FIG. 3 is a horizontal section of part of the machine at the level of one of the printing units, this sectional view being drawn along line III—III of FIG. 1.
Figure 4:
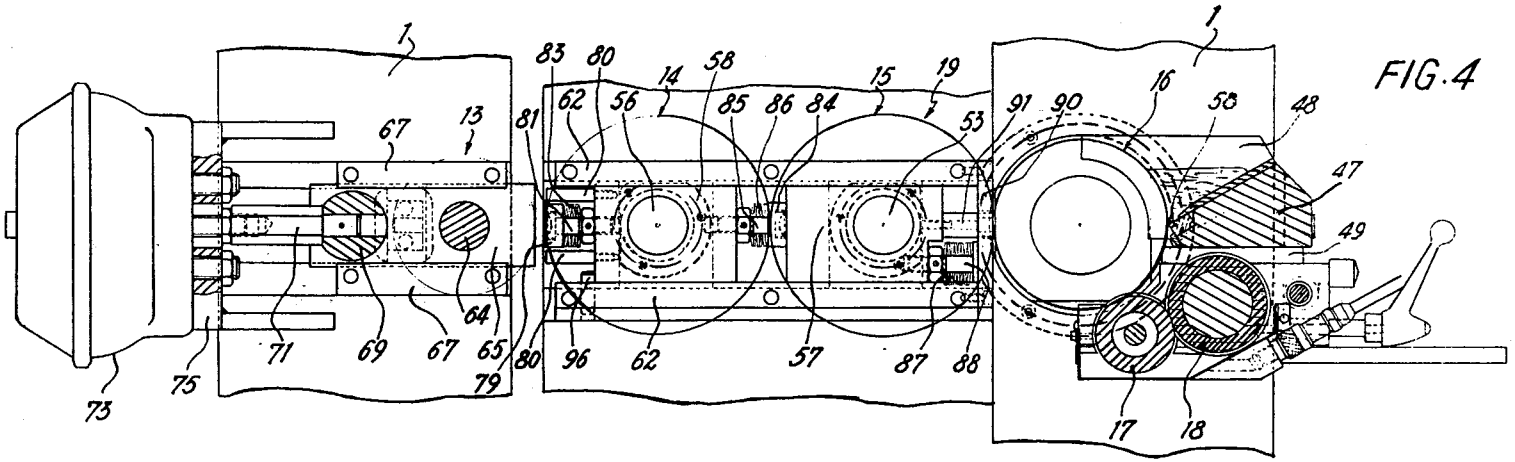
FIG. 4 is a vertical longitudinal sectional view drawn on a larger scale and along line IV—IV of FIG. 2.
Figure 5:
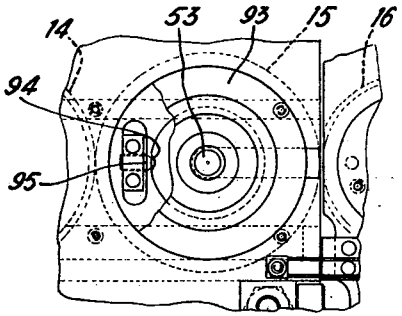
FIG. 5 is an elevational view of part of the indexing means of a plate roll.

Referring now to FIGS. 3 to 5, in each printing unit the rotary movement of the various rolls is transmitted to them from the inking roll 16. For this purpose, a helical pinion 51 is keyed on to the shaft 45 of the inking roll 16, and this pinion meshes with another helical pinion 52 keyed on to the shaft 53 of the plate roll 15, in the rear portion of the sub-frame 19. The shaft 53 of the plate roll 15 is itself solidly connected, in the front portion of the sub-frame 19, to an axially-toothed pinion 54 which meshes with another axially-toothed pinion 55 keyed on to the shaft 56 of the blanket roll 14 at the front of the latter.

The shafts 53 and 56 of the plate roll 15 and the blanket roll 14 respectively are mounted to rotate in bearings 57 and 58 respectively at the rear, and in bearings 59 and 61 at the front. These bearings are mounted to slide in pairs of horizontal rails 62 and 63 carried by the inner faces of the rear cheek plates 21 and the front cheek-plate 22 respectively of the sub-frame 19.

The counter-pressure roll 13 is mounted to rotate on the two uprights 1 and 2 of the main frame, in the opposite sense to the inking roll 16. For this purpose the counter-pressure roll 13 is mounted by means of roller bearings on a fixed shaft 64 secured by its ends to two vertical cheek plates 65 and 66 which are mounted to slide horizontally in slideways formed by rear and front pairs of horizontal rails 67 and 68. The two cheek plates 65 and 66 are interconnected by a stay 69 parallel to the counter-pressure roll 13, which stay is connected to the rods 71 and 72 of two diaphragm chambers 73 and 74 respectively secured to a transverse vertical cheek plate 75 extending between the two uprights 1 and 2. The rods 71 and 72 extend horizontally and at right-angles to the counter-pressure roll 13 so as to apply horizontal thrust to this roll in the direction of the other rolls of the printing unit.

Normally the counter-pressure roll 13 is biased away from the blanket roll 14 by the action of springs 76 housed in the uprights 1 and 2 and supported on studs 77 and 78 respectively, extending laterally towards the exterior fo the cheek plates 65 and 66 respectively. This return force of the springs 76 is supplemented by the forces applied by springs forming part of the diaphragm chambers 73 and 74 and biasing the rods 71 and 72 in the return direction.

The cheek plates 65 and 66 are used to press the blanket roll 14 and the plate roll 15 against each other and to apply pressure to the inking roll 16. For this purpose the cheek plates 65 and 66 bear by their vertical front faces on shoes 79 which are carried by the rear and front bearings 58 and 61 respectively of the blanket roll 14. Each shoe 79 is mounted to slide along a screw 81, screwed into and blocked in the corresponding bearing 58 and 61, the head of each screw limiting the movement of the shoe 79 in the outward direction. Between each shoe 79 and its bearing 58 or 61 (or a locking nut) is lodged a compression spring 83 formed for example by a stack of spring washers. Rods 80 (see FIG. 4) of adjustable length are mounted on the left-hand front faces of the bearings 58 and 61 to limit the compression forces between the counter-pressure roll 13 and the blanket roll 14, that is to limit the width of the area of contact at this point.

Shoes 84 are mounted to slide on screws 85 secured respectively to each of the right-hand front faces of the bearings 58 and 61, opposite to the screws 81 carrying the shoes 79. A compression spring, formed for example by a stack of spring washers 86, is again provided here between each shoe 84 and the corresponding bearing 58 or 61 so as to push this shoe outwardly.

The shoes 84 bear against the left-hand front faces of the rear and front bearings 57 and 59 respectively of the plate roll 15. In the same way, compressions springs 87 (see FIG. 4), consisting for example of a stack of spring washers threaded on screws 88, bear against the right-hand front faces of these same bearings. The springs 87 bear against an abutment 90 formed for example by a vertical cross-member extending between the two horizontal rails 62 and at the right-hand ends thereof.

Also, rods 91 are mounted on the right-hand front faces of the bearings 57 and 59, which rods serve to adjust the width of the contact area as described below, and are likewise designed to move into abutment with the left-hand front faces of the bearings 46.

To enable the various plate rolls 15 to be secured in their correct positions after a plate has been changed, the shafts 53 of these rolls carry, at the exterior of the front cheek plate 22, indexing discs 92 (see FIG. 3) which are solidly connected to hand-wheels 93. The indexing discs 92 each have at their periphery a notch 94 in which can engage a ball-ended stud 95 or a member mounted on a spring-biased pivoting lever.

A particularly convenient and rapid method will now be described whereby the operation of changing the plates can be carried out when one printing run has been completed and the machine is to carry out the printing of a fresh run.

On completion of the printing of the first run, the various elements forming the machine are in the printing positions illustrated in the drawings. All the inking rolls 16 are rotated by the main operating shaft 39 and their movements are transmitted first to the plate rolls 15 by way of the helical pinions 51 and 52 meshing with each other, and then to the blanket rolls 14 by way of the interengaging pinions 54 and 55. The counter-pressure rolls 13 are applied under pressure against the blanket rolls 14 under the action of the diaphragm chambers 73 and 74. The force provided by these diaphragm chambers is applied, in each printing unit, by the lateral cheek plates 65 and 66 to the sliding bearings 57, 58, 59 and 61. Consequently, the compression springs 83, 86 and 87 are compressed, and the plate rolls 15 are pressed against the respective inking rolls 16, this causing a certain degree of flattening of their rubber coverings. The extent of this flattening, to which corresponds what is known as the inking width, is determined by the length of the adjusting rods 91 which form stops interposed between the last sliding bearings 57 and 59 of each plate roll 15 and the fixed bearings 46 of the inking roll 16.

When the rotary printing machine has been stopped after the previous printing run has been completed, the supply to the diaphragm chambers 73 and 74 is cut off, and consequently the pressure on the rolls of the various printing units ceases. As a result, each counter-pressure roll 13 is moved to the left (as seen in the drawings) under the action of the return springs 76 mounted in the main frame and by the inner springs in the diaphragm chambers 73 and 74. Consequently, the various compression springs 83, 86 and 87 relax to the extent that each plate roll 15 is moved to the left away from the corresponding plate roll 15 as a result of relaxation of the springs 86. Leftward displacement of each plate roll 15 relatively to its inking roll 16 is greater than the distance between the corresponding blanket roll 14 and the corresponding plate roll 15, so as to prevent the plate roll 15 from moving into contact with the inking roll 16 when the sub-frame 19 finally moves out of the machine. Once the various rolls of the printing unit have been relieved of pressure, the sub-frame 19 can then be moved out of the machine by causing it to move forward on the lower rails 27 into its completely extracted position shown in thin lines in FIG. 2. During this movement, the sub-frame is laterally guided by the rollers 31 and 34.

Once the sub-frame 19 is in the forward "out" position, the plates of the various rolls 15 can be changed very easily and rapidly for the purpose of starting up the next printing run. Before reintroducing the sub-frame 19 into the machine, the other elements, particularly those of the cutting apparatus 11, are secured in the correct position. For this purpose, the printed sheet material 7 passes on to an upper driving roll 96 (see FIG. 1), to which is solidly connected an indexing disc 97 having a notch 96 formed in its periphery. An indexing finger 99, carried for example on a pivoting lever, engages in this notch. The driving roll 96 is connected to a main operating shaft 94 by way of a set of gears 100. Before reintroducing the sub-frame 19, the elements of the machine are secured in the correct position by rotating the hand-wheel 41 manually until the notch 98 is in register with the indexing finger 99. At this moment all the pinions 51 of the inking rolls 16 are accurately positioned for subsequently engaging the pinions 52 of the plate rolls 15, and the other elements of the machine are correctly positioned in relation to the new plates.

Once the new plates have been placed in position, all that is required is to secure all the plate rolls 15 in their correct positions, that is to say in the positions in which the indexing fingers 95 engage in the notches 94 in the indexing discs 92. The various plates are then correctly positioned in relation to each other for printing the various colours.

The sub-frame 19 is then reintroduced into the machine and brought into a position in which its rear cheek plate 21 lies flat against the rear upright 1. At this moment, the diaphragm chambers 73 and 74 are pressurised, and as a result all the counter-pressure rolls 13 are pushed to the right. The lateral cheek plates 65 and 66 in turn push the sliding bearings 57, 58, 59 and 61 to the right thereby compressing springs 83, 86 and 87. The springs 87, provided between the plate rolls 15 and the inking rolls 16, exercise, when completely compressed, a force which is less than the forces produced by the other compression springs 83 and 86. For example, if the diaphragm chambers 73 and 74 apply a force of 10,000 Newtons on each set of bearings, this total force is distributed as a force of 4000 Newtons, absorbed by the compression springs 83 between the counter-pressure roll 13 and the blanket roll 14, a force of 4000 Newtons, absorbed by the springs 86 between the blanket roll 14 and the plate roll 15, and finally a force of 1000 Newtons, absorbed by the springs 87. Consequently, when the diaphragm chambers 73 and 74 are pressurised, the springs 87, which are weaker, are the first to be flattened as the plate roll 15 moves into contact with the inking roll 16 and the helical pinion 52 engages with the other helical pinion 51 solidly connected to the inking roll 16. As has been seen already, flattening of the inking roll 16 is limited by the adjusting rods 91. Then, the other compression springs 83 and 86 become flattened and thus permit contact under pressure between the blanket roll 14 and the plate roll 15, and between the counter-pressure roll 13 and the blanket roll 14.

As will have been seen above, this rotary printing machine enables the use of electronic means for registering the various colours to be avoided because the printing units are very close to each other. However, it is absolutely essential for the plates as well as selected portions of the plates to be in perfectly matching positions on the rolls 15. To ensure perfect postiioning, the various documents used for engraving the plates (films, selections etc) are perforated in a completely identical manner on the same templates so that they can be held in position by means of pins. In the case of four-colour printing, the four films are superposed in a precise manner and are perforated all at the same time. After engraving on a copying machine having registering pins, the selections are then matched in an identical manner on the plates in relation to the perforations. The perforating template is repeated exactly on the means for securing the plates on the rolls 15 by means of pins, and to register the colours all that is then required is to position the rolls mechanically, as described above.

In the foregoing description, it was mentioned that the plates are replaced on the sub-frame 19 after the latter has been moved out of the machine, and that the sub-frame is then reintroduced into the machine with its fresh plates. Obviously, to save time, a second sub-frame 19, provided with plates suitable for printing the next run, can be prepared in advance and introduced immediately into the machine after the previous sub-frame has been extracted.

Figure 6:
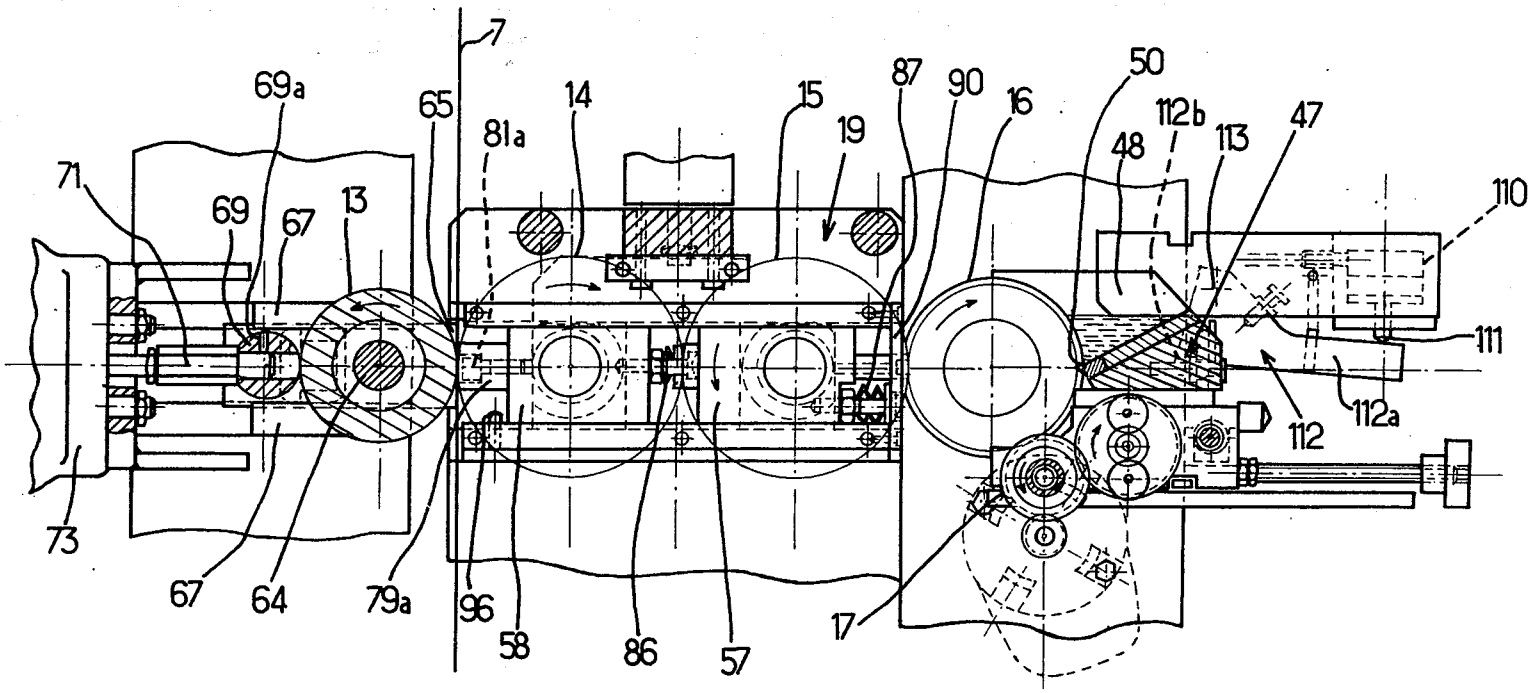
FIG. 6 is a partial vertical longitudinal section through a modified form of printing unit of the printing machine.

FIG. 6 illustrates the same elements forming the rotary printing machine of the invention as those appearing in FIG. 4, these elements bearing the same reference numerals as the corresponding elements in FIG. 4. FIG. 6 shows the counter-pressure roll 13, the blanket roll 14, the plate roll 15, and the inking roll 16, with which the inking rod 50 and the wetting roll 17 are in contact.

The counter-pressure roll 13 is mounted to rotate on a fixed shaft 64 which is secured at its ends to two vertical cheek plates such as that shown at 65, these cheek plates being mounted to slide horizontally in slideways formed by pairs of horizontal rails such as that shown at 67. The two cheek-plates 65 are interconnected by a stay 69 which is parallel to the counter-pressure roll 13 and is connected to the rods 71 of diaphragm chambers such as that shown at 73. The connection between the rods 71 and the cross-member 69 is achieved by means of screws or studs 69*a*.

As in the case of the arrangement shown in FIG. 4, the cheek plates 65 are used to press the blanket roll 14 and the plate roll 15 against each other and towards the inking roll 16. For this purpose, the cheek plates 65 bear by their right-hand vertical front faces against shoes 79*a* which are secured, by means of screws 81*a*, to the left-hand vertical faces of bearings such as that shown at 58, of the shaft of the blanket roll 14. It will be seen that in this arrangement the springs 83 which were provided in the FIG. 4 arrangement, have been dispensed with.

On the other hand, the second compression springs 86 (formed for example by stacks of spring washers) are provided between the bearings, such as that shown at 58, of the blanket roll 14 and the bearings, such as that shown at 57, of the plate roll 15. Similarly, the third compression springs 87 are likewise provided between the right-hand faces of bearings, such as that shown at 57, and the abutment 90. It can thus be seen that in accordance with the preceding description, in this form of construction only the springs 86 and 87 are retained but use is made of stacks of spring washers such that the force emanating from the springs 86 is less than that provided by the springs 87.

Consequently, when the printing unit is displaced under pressure, (with the various rolls still rotating) that is when the sliding cheek plates 65 are moved to the left by the diaphragm chambers 73, the springs 87 first cause the plate roll 15 to move away from the inking roll 16, the plate roll 15 however always remaining in contact with the blanket roll 14 which is applied to the counter-pressure roll 13. The sheet of paper 7 continues to pass between these two latter rolls 13 and 14. Consequently, the ink present on the plate roll 15 is pregressively transferred to the blanket roll 14 and to the sheet of paper 7.

Then, when the counter-pressure roll 13 has been moved a sufficient distance away by the diaphragm chambers 73, the bearings 58 of the blanket roll 14 are again pushed against the abutments 96 under the action of the weaker springs 86. When the movable sub-frame 19 is disengaged from the frame of the machine in the transverse direction, the plate roll 15 is then already partially cleaned, and this greatly reduces the time required for this cleaning operation.

In accordance with a further improved feature of this form of construction, the ink-container assembly 47, which comprises a round metallic rod 50 rotated by an electric motor, is applied under pressure to the inking roll 16 by means of two pneumatic piston-and-cylinder units 110 which are arranged vertically at each side of the ink container. Each of these pneumatic piston-and-cylinder units 110 acts, by way of the end of its piston-rod 111, on the end of one arm 112*a* of a lever 112 which is mounted to pivot about a horizontal transverse axis 113. Each lever 112 has a further arm 112*b* whereby it is connected to the ink container 47. Consequently, when each pair of pneumatic piston-and-cylinder units 110 is supplied with air through its base, the piston-rods 111 apply to the levers 112 forces which tend to cause the levers to pivot in the clockwise direction about the axis 113, and this has the effect of pressing the ink container 47, and more particularly the rod 50, against the inking roll 16.

Figure 7:
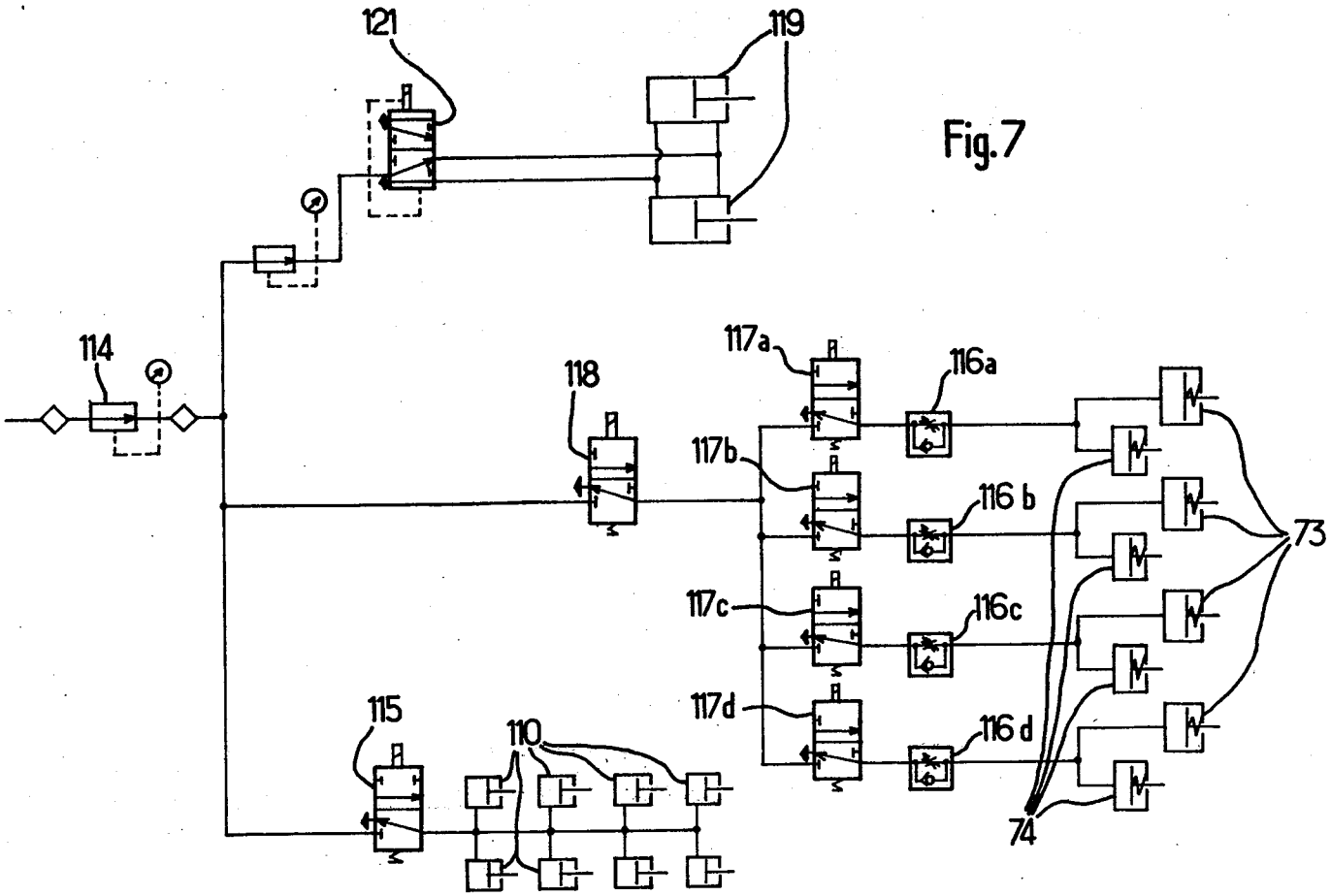
FIG. 7 is a diagram showing the pneumatic control circuit of the machine.

With particular reference to FIG. 7, the automisation of the rotary printing machine will now be described.

The assembly comprising the pneumatic components of the machine 13 connected to a compressed-air source 114. It will be seen from FIG. 7 that the four pairs of pneumatic piston-and-cylinder units 110, which apply pressure to the ink containers 47 corresponding to the four colours, are connected to this compressed-air source 114 through an electrically operated valve 115. Similarly, the diaphragm chambers 73 and 74 which control the application of pressure to the various printing units are connected to the compressed-air source 114 by way of separate control devices 116*a*, 116*b*, 116*c* and 116*d* and separate electrically operated valves 117*a*, 117*b*, 117*c*, and 117*d*. These four electrically operated valves are in turn connected to the output side of an electrically operated valve 118 which permits the application of pressure.

Finally, two piston-and-cylinder units 119 for driving the sheet material 7 are likewise connected to the compressed-air source 114 and they ensure that the sheet material is gripped between a lower idling roll and the upper driving roll 96, these driving piston-and-cylinder units being connected to the compressed-air source by way of pneumatic distributor 121.

When the printing machine is started up, pressure is first applied to the ink containers; the pneumatic piston-and-cylinder units 110 are in fact supplied through the electrically operated valve 115. Then, after a time-lag which may be varied over the range 0.1 to 30 seconds, the main motor 36 is started up, pressure is admitted to the driving piston-and cylinder units 119 through the pneumatic distributor 121, and the valve 118, permitting the application of the printing pressure, is opened. Pressure can then be applied manually to each printing unit by admitting air to the pair of diaphragm chambers 73 and 74 through the corresponding electrically operated control valve 117*a*, 117*b*, 117*c* and 117*d*. This manual application of pressure to each printing unit can take place only if the wetting means is turning and is itself under pressure.

The rotary printing machine is normally brought to a stop by means of a push-button on a control desk, depression of this push-button causing the printing units to be depressurised simultaneously (air being cut off from the diaphragm chambers 73 and 74), and after an adjustable time-lag, the drive is stopped (air being cut off from the piston-and-cylinder units 119). At the same time pressurization ceases (the electrically operated valve 118 being closed), the motor 36 is stopped and pressure on the ink container is relaxed (air being cut off from the pneumatic piston-and-cylinder units 110).

The control devices 116*a*, 116*b*, 116*c* and 116*d* are provided to adjust the time during which the contact between plate and blanket is maintained when changing from one printing unit to another so as to reduce as far as possible the amount of ink on the plate.

I claim:

1. A rotary multi-color printing machine, particularly of the offset type, comprising a frame, a plurality of printing units carried by said frame and superposed one above the other so that sheet material, on which the various colors are to be printed, can pass through them successively, each printing unit comprising four horizontal rolls, which are situated at the same level and whose axes are parallel, the four rolls being constituted by a counter-pressure roll, a blanket roll, a plate roll and an inking roll, the inking roll forming part of an inking means for inking said plate roll; the machine further comprising a support which is slidable relative to the frame of the printing machine in a direction which is horizontal and axial with respect to the four rolls, the plate roll and the blanket roll of each of the printing units being rotatably mounted on said support, whereas the counter-pressure roll of each printing unit is rotatably mounted on said frame at one side of the support, and the inking roll of each printing unit is rotatably mounted on said frame at the other side of the support.

2. A printing machine according to claim 1, wherein said frame is constituted by two parallel uprights, namely a rear upright and a front upright; two lower horizontal transverse rails secured to the lower parts of the two uprights of said frame and extending towards the front of the printing machine and resting on the ground; two upper horizontal transverse straight-edged elements, secured to the upper parts of the two uprights of said frame and extending towards the rear of the printing machine; and the support consists of a sub-frame comprising two vertical rear and front cheek plates parallel with the vertical uprights of said frame; upper and lower stays, transversely interconnecting the two rear and front cheek plates; side rollers carried by the lower stays and running on two horizontal transverse rails extending to the front; side guide rollers carried by the lower stays; a cross-member mounted on the upper part of the sub-frame and extending between the two cheek-plates of the sub-frame; and guide rollers carried by the upper cross-member and running between the two upper transverse straight-edged elements secured to the uprights of said frame.

3. A printing machine according to claim 2, further comprising a vertically extending main operating shaft; an electric motor for causing said main operating shaft to rotate; endless screws carried by said main operating shaft, one endless screw being located at the level of each of the several printing units; horizontal shafts of the inking rolls of the printing units which are mounted to rotate on said frame of the printing machine; toothed wheels solidly mounted on the shafts of the inking rolls, each toothed wheel engaging one of the endless screws carried by the main operating shaft; shafts of the plate rolls of the printing units, mounted to rotate on the horizontally sliding supports; a first pinion solidly mounted on the shaft of each inking roll; a second pinion solidly mounted on the shaft of each plate roll and meshing with a first pinion solidly connected to the shaft of the inking roll of the same printing unit; a third pinion solidly mounted on the shaft of each plate roll; shafts on the blanket rolls of the printing units; and a fourth pinion solidly mounted on the shaft of each blanket roll and meshing with the third pinion solidly mounted on the shaft of the corresponding plate roll.

4. A printing machine according to claim 3, comprising horizontal rails forming slideways on the inner faces of the front and rear cheek plates of the sliding sub-frame; bearings supporting; in each printing unit, the shaft of the plate roll and the shaft of the blanket roll, said bearings being mounted to slide in the slideways formed by the horizontal rails of the sub-frame; fixed bearings carried by the uprights of said frame of the printing machine on one side of the horizontally sliding sub-frame and supporting the shaft of the inking roll of each printing unit; horizontal rails forming slideways carried by the inner faces of the front and rear uprights of said frame of the printing machine; cheek plates mounted on the other side of the sliding sub-frame, to slide horizontally in slideways carried by the inner faces of the uprights and supporting the shaft of the counter-pressure roll of each printing unit; a cross-member interconnecting the two horizontally sliding cheek plates associated with one and the same printing unit, and at least one diaphragm chamber comprising a rod connected to said cross-member to apply pressure to the counter-pressure roll of each printing unit and, by way of this latter roll, to the other rolls of each printing unit, namely the blanket roll, the plate roll and the inking roll.

5. A printing machine according to claim 4, comprising first compression springs interposed between the cheek plates which slide on the inner faces of the uprights of said frame and carry the counter-pressure rolls, and the bearings of the blanket rolls; second compression springs interposed between the bearings of the blanket rolls and the bearings of the plate rolls; stops provided on the sub-frame constituting the support, at the side of the inking rolls, and third springs interposed between the bearings of the plate rolls and said stops; the third springs applying a smaller force than that of the first and second springs so that when pressure is applied to the rolls, the third springs are flattened before the first and second springs.

6. A printing machine according to claim 5, wherein the stops limit the outward movement of the bearings of the blanket rolls under the action of the second and third springs.

7. A printing machine according to claim 5, comprising rods for adjusting the inking width and carried by the bearings of the plate rolls, these rods bearing against the bearings of the inking rolls to limit, to a predetermined value, the degree of flattening of the surface covering of these latter rolls when pressure is applied to the rolls.

8. A printing machine according the claim 5, comprising rods for adjusting the inking width carried by the bearings of each blanket roll and facing the cheek plates sliding on the uprights of said frame, to adjust the degree of flattening of each counter-pressure roll.

9. A printing machine according to claim 3, comprising an indexing disc solidly mounted on the shaft of each plate roll; an indexing notch formed in each indexing disc; respective indexing fingers resiliently mounted on the front cheek plate of the supporting sub-frame and each adapted to engage in the corresponding indexing notch of the indexing disc; a control hand-wheel solidly mounted on the shaft of each plate roll; a rotatable shaft carried by said frame of the machine; a second indexing disc solidly mounted on this rotatable shaft; a second indexing notch formed in the periphery of the second indexing disc; and a second indexing finger adapted to engage in the second indexing notch.

10. A printing machine according to claim 4, comprising, in each printing unit, blocks solidly connected to the bearings supporting the shaft of the blanket roll; the cheek plates, sliding on the uprights of the main frame of the printing machine, being adapted to move into direct contact with these blocks without the interposition of springs; second compression springs interposed between the bearings of the blanket roll and the bearings of the plate roll and being relatively weak; and third springs interposed at the other side of the second relatively weak springs between the bearings of the plate roll andstops provided on the supporting subframe, said third springs being relatively strong and applying to the bearings of the plate roll, a force that is greater than that of the second springs.

11. A printing machine according to claim 1, comprising, in each printing unit, said inking means consisting of an ink container, a rotatable rod at the base of the ink container and in contact with the inking roll, and means for rotating the rod, and at least one pneumatic piston-and-cylinder unit for pressing the rod on to the inking roll.

12. A printing machine according to claim 11, comprising, on each side of the inking container of the inking means, a vertically arranged pneumatic piston-and-cylinder unit and a lever mounted to pivot about a horizontal transverse axis, this level having a first arm on which acts the end of the piston-rod of the associated pneumatic piston-and-cylinder unit, and a second arm whereby it is connected to the ink container.

13. A printing machine according to claim 11, comprising, a compressed-air source to which can be connected the pneumatic piston-and-cylinder units for applying pressure to the ink containers; a first electrically operated valve connected between the compressed-air source and the pneumatic piston-and cylinder units; diaphragm chambers for applying pressure to the various printing units and connected to the compressed-air source; separate control devices and separate second electrically operated valves connected to the feed circuit for the diaphragm chambers; a third electrically operated valve, controlling the application of pressure, to the output side of which are connected the separate second electrically operated valves; at least one piston-and-cylinder unit for driving a sheet material; and a pneumatic distributor connected between the driving piston-and-cylinder unit and the compressed-air source.

* * * * *